US005744918A

United States Patent [19]

Sugawara et al.

[11] Patent Number: 5,744,918

[45] Date of Patent: Apr. 28, 1998

[54] DISPLAY MONITOR

[75] Inventors: Yoshihiko Sugawara; Hideyuki Mochida; Kazuyoshi Takizawa, all of Kanagawa, Japan

[73] Assignee: Hitachi Media Electronics Co., Ltd., Iwate, Japan

[21] Appl. No.: 761,785

[22] Filed: Dec. 6, 1996

[30] Foreign Application Priority Data

Jan. 18, 1996 [JP] Japan ..... 8-006747

[51] Int. Cl.[6] ..... H01J 29/70

[52] U.S. Cl. ..... 315/411

[58] Field of Search ..... 315/411; 363/21

[56] References Cited

U.S. PATENT DOCUMENTS 4,301,394 11/1981 Dietz ..... 315/408

4,321,514 3/1982 Thibodeau et al. ..... 315/411

*Primary Examiner*—Theodore M. Blum

*Attorney, Agent, or Firm*—Evenson, McKeown, Edwards & Lenahan, P.L.L.C.

[57] ABSTRACT

A display monitor which comprises a flyback transformer for supplying a high voltage to a display and an opposite-phase pulse inducing transformer. The flyback transformer includes a core, a primary-side low-voltage coil wound on the core, a secondary-side high-voltage coil wound on the core and divided into high-voltage coil pieces, rectifier diodes connected in series with respective output sides of the high-voltage coil pieces of the secondary-side high-voltage coil so as to form a series circuit, and a high-voltage capacitor connected to a cathode of one of the high-voltage rectifier diodes in a final stage of the series circuit. The opposite-phase pulse inducing transformer is constituted by a core different from the core of the flyback transformer, an opposite-phase pulse inducing coil wound on the different core for inducing a pulse which is opposite in phase to a deflecting yoke driving horizontal pulse, and a different-core high-voltage output line provided on the different core, the opposite-phase pulse inducing transformer being arranged so that the pulse opposite in phase to the deflecting yoke driving horizontal pulse is superimposed on the different-core high-voltage output line.

4 Claims, 11 Drawing Sheets

DISPLAY MONITOR

BACKGROUND OF THE INVENTION

1. Field of the Invention

The present invention relates to a display monitor provided with a cathode-ray tube, and particularly to a display monitor in which an alternating electric field generated through the surface or the like of a cathode-ray tube can be reduced.

2. Description of the Related Art

FIG. 8 shows an example of a circuit for reducing an alternating electric field radiated from the surface or the like of a cathode-ray tube by using an externally-provided high-voltage capacitor in a flyback transformer (hereinafter abbreviated to "FBT") which is used as a high-voltage generating transformer in a general display monitor. This circuit is an example to which the technique disclosed in U.S. Pat. No. 5,218,270 is applied.

In FIG. 8, the reference numeral 1 designates an FBT; 2, an built-in high-voltage capacitor; 3*a*–3*d*, high-voltage rectifier diodes; 4, a tertiary-side winding for generating an opposite-phase pulse; 5, an externally-provided high-voltage capacitor; 6, a high-voltage coil which is divided into high-voltage coil pieces 6*a* to 6*d*; 7, a deflecting yoke; 15, a core of the FBT 1; 16, a horizontal output transistor; 17, a primary-side low-voltage coil; and 18, a waveform comparison/controller.

As shown in FIG. 8, the high-voltage rectifier diodes 3*a* to 3*d* are respectively connected in the same polarity in series to the output sides of the high-voltage coil pieces 6*a* to 6*d* of the secondary-side high-voltage coil to form a series circuit of the coil piece 6*a*, the diode 3*a*, the coil piece 6*b*, the diode 3*b*, the coil piece 6*c*, the diode 3*c*, the coil piece 6*d* and the diode 3*d*, in order. The high-voltage capacitor 5 is connected to the cathode of the high-voltage rectifier diode 3*d* in the final stage of this series circuit.

FIG. 9 shows an example of a conventional alternating electric field reducing system. In FIG. 9, the reference numeral 8 designates an interior graphite film; 9, an electrostatic capacity of the deflecting yoke; 10, a high-voltage deflecting circuit; and 11; a cathode-ray tube.

In this system, the electric charge $Q_1$ of the interior graphite film 8 can be expressed by the following expression.

$$Q_1 = K \times C_{DY} \times V_{DY}$$

wherein K is a constant which is nearly equal to 0.5, $C_{DY}$ is the value of the defection yoke capacity 9, and $V_{DY}$ is the value of the horizontal pulse.

The opposite-phase pulse $e_x$ to be superimposed for canceling an alternating electric field is selected so that the superimposed electric charge is equal to the electric charge $Q_1$ of the interior graphite film 8.

This selection depends on the capacity $C_1$ of the built-in high-voltage capacitor 2, the capacity $C_2$ of the cathode-ray tube 11, and the peak value $e_p$ of the opposite-phase pulse $e_x$. The number of turns of the opposite-phase generating winding 4 is determined taking the capacity $C_1$ of the built-in high-voltage capacitor 2 into consideration, so that an opposite-phase pulse $e_x$ is applied and superimposed to the interior graphite film 8 to thereby reduce the amplitude of an alternating electric field $V_{LEF}$.

FIG. 10 shows equivalently the alternating electric field reducing system in FIG. 9. In FIG. 10, the reference numeral 13 designates a panel transparent conductive film; 12, the surface resistance of the panel transparent conductive film 13; and 14, the capacity of the panel transparent conductive film 13.

A horizontal pulse $V_{DY}$ (1,000 $V_{pp}$) for driving the deflecting yoke 7 causes a pulse voltage $V_{DY'}$ on the interior graphite film 8 of the cathode-ray tube 11 through the electrostatic capacity 9 ($C_{DY}$=60 pF) of the deflecting yoke 7. This pulse voltage $V_{DY'}$ is impedance-divided by the capacity 14 and the surface resistance 12 of the panel transparent conductive film 13 to generate a pulse $V_P$ on the panel transparent conductive film 13. The pulse $V_P$ becomes a source to generate an alternating electric field.

As an example of reducing this alternating electric field $V_{LEF}$, as mentioned above, an opposite-phase pulse $V_{F'}$ (−150 Vpp) obtained by the tertiary-side opposite-phase pulse generating winding 4 of the FBT 1 is applied to the interior graphite film 8 through the high-voltage capacitor 5 (capacity $C_F$=200 pF) of the FBT 1 so that the pulse voltage $V_{DY'}$ is canceled with the opposite-phase pulse $V_{F'}$ on the interior graphite film 8 to thereby reduce the amplitude of the alternating electric field $V_{LEF}$, radiated from the cathode-ray tube 11. This relation can be expressed by the following expression.

$$\begin{aligned} K \times C_{DY}(60\text{ pF}) \times V_{DY}(-1{,}000 V_{pp}) &= -3 \times 10E-8[C] \\ &= C_F(200\text{ pF}) \times V_F'(-150 V_{pp}) \end{aligned}$$

where K is nearly equal to 0.5.

FIG. 11 is a diagram showing the appearance of a conventional externally-provided high-voltage capacitor, and FIG. 12 is a circuit diagram thereof.

In these drawings, the reference numeral 5 designates an externally-provided high-voltage capacitor; 19, an anode cap; 20, a high-voltage connector; and 21, a ground terminal.

As shown in FIG. 11, the externally-provided high-voltage capacitor 5 requires high-voltage insulation which is realized, for example, by a large-sized exterior housing of about 40 mm×40 mm×65 mm and injection resin such as epoxy resin or the like filling the exterior housing. The capacitor 5 is therefore expensive in cost, is limited in place of provision in the display monitor, and is difficult in handling in view of its structure. Further, there is another problem that it is difficult to ensure the reliability of a high-voltage connecting portion (such as the high-voltage connector 20) because high-voltage connection is required.

SUMMARY OF THE INVENTION

It is therefore an object of the present invention to solve the foregoing problems.

It is another object of the present invention to provide a display monitor which is low in price, easy in high-voltage insulation, and good in handling, and by which an alternating electric field can be reduced.

In order to attain the foregoing objects, according to an aspect of the present invention, a display monitor comprises a flyback transformer for supplying a high voltage to a display and an opposite-phase pulse inducing transformer. The flyback transformer includes a core, a primary-side low-voltage coil wound on the core, a secondary-side high-voltage coil wound on the core and divided into high-voltage coil pieces, high-voltage rectifier diodes connected in series with respective output sides of the high-voltage coil pieces of the secondary-side high-voltage coil so as to form a series circuit, and a high-voltage capacitor connected to a cathode of one of the high-voltage rectifier diodes in a final stage of the series circuit. The opposite-phase pulse inducing transformer is constituted by a core different from the core of the flyback transformer, an opposite-phase pulse inducing coil wound on the different core for inducing a pulse which is opposite in phase to a deflecting yoke driving horizontal pulse, and a different-core high-voltage output line provided on the different core, the opposite-phase pulse inducing transformer being arranged so that the pulse opposite in phase to the deflecting yoke driving horizontal pulse is superimposed on the different-core high-voltage output line.

Preferably, an opposite-phase pulse control circuit for adjusting the peak value and phase of the pulse opposite in phase to the deflecting yoke driving horizontal pulse is connected to the opposite-phase pulse inducing transformer.

Preferably, the opposite-phase pulse inducing transformer includes a circuit in which a capacitor and a resistor are connected in series with each other, and an inductor is connected in parallel with the series circuit of the capacitor and the resistor.

Preferably, the pulse opposite in phase to the deflecting yoke driving horizontal pulse is generated by the flyback transformer, and supplied to a cathode-ray tube through the opposite-phase pulse inducing transformer.

Preferably, the core of the opposite-phase pulse inducing transformer is a halved toroidal core in which a ring-like core is halved and cut surfaces of the halves are made abut against each other.

DETAILED DESCRIPTION OF THE PREFERRED EMBODIMENTS

Figure 1:
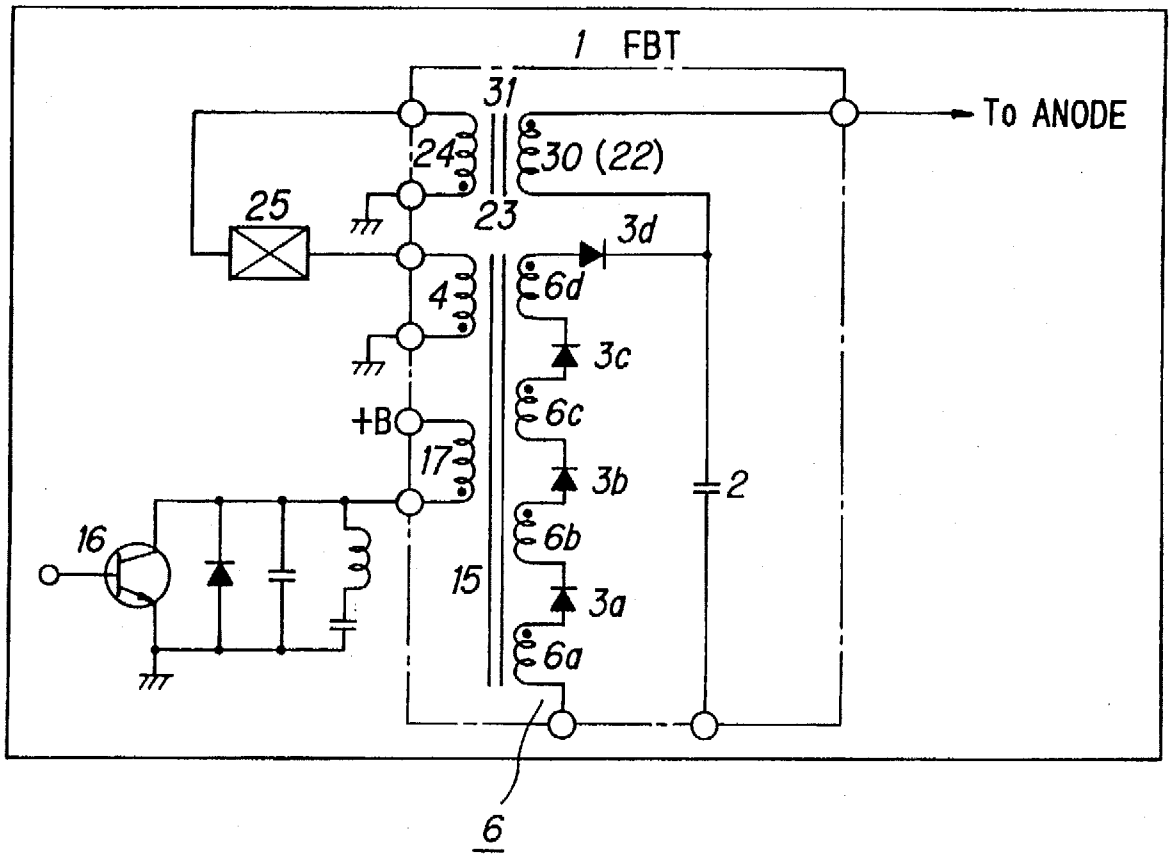
FIG. 1 is a circuit diagram of a display monitor according to an embodiment of the present invention.

Embodiments of the present invention will be described below with reference to the drawings. FIG. 1 is a circuit diagram of an FBT according to an embodiment of the present invention.

Figure 8:
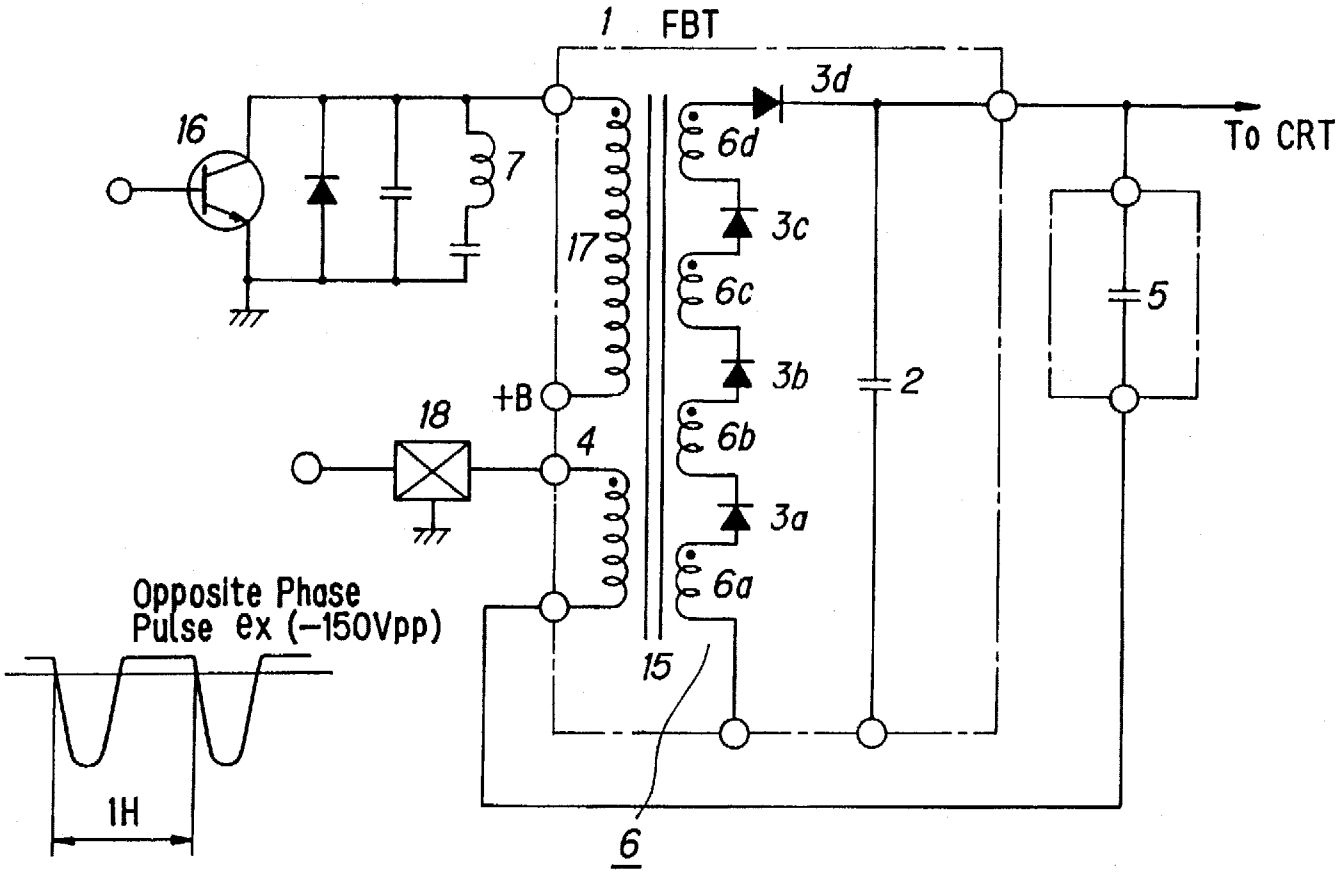
FIG. 8 PRIOR ART
FIG. 8 is a circuit diagram of a conventional FBT for supplying a high voltage to a cathode-ray tube for reducing an alternating electric field.
Figure 9:
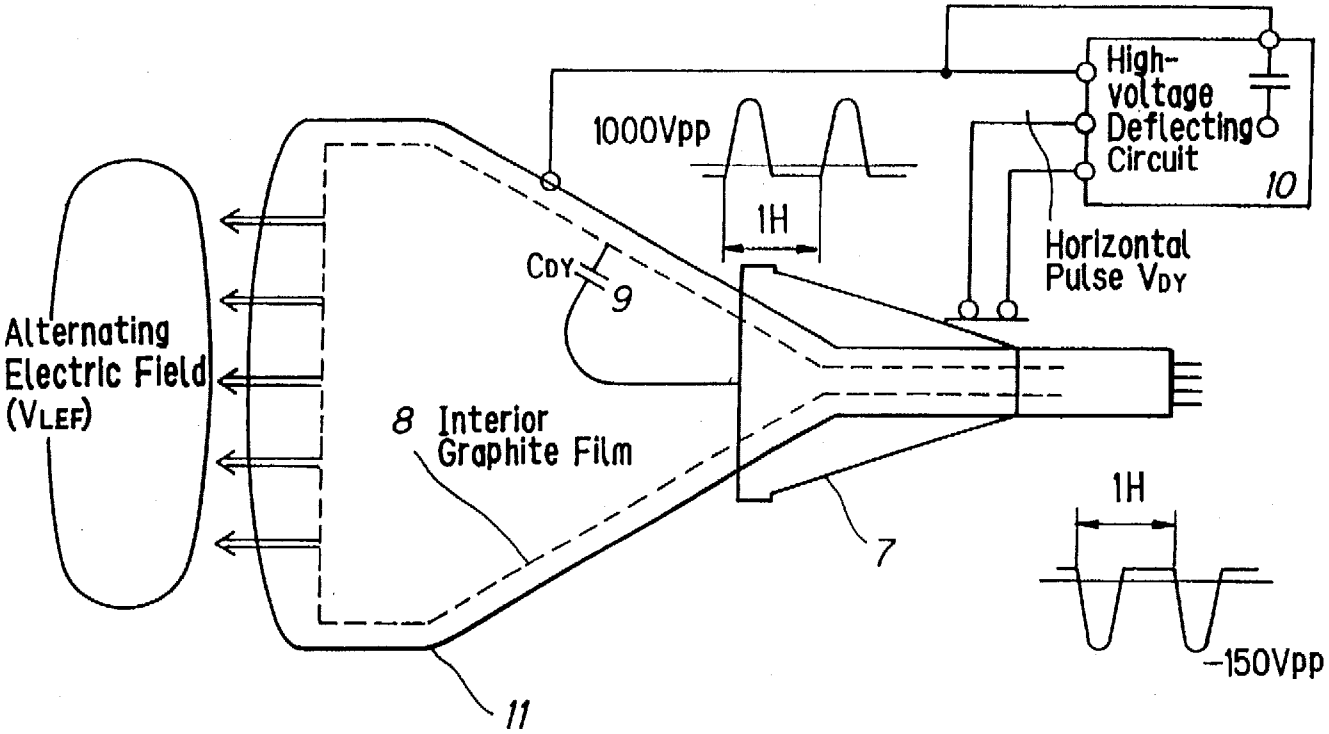
FIG. 9 PRIOR ART
FIG. 9 is a diagram for explaining a system for reducing the alternating electric field.
Figure 10:
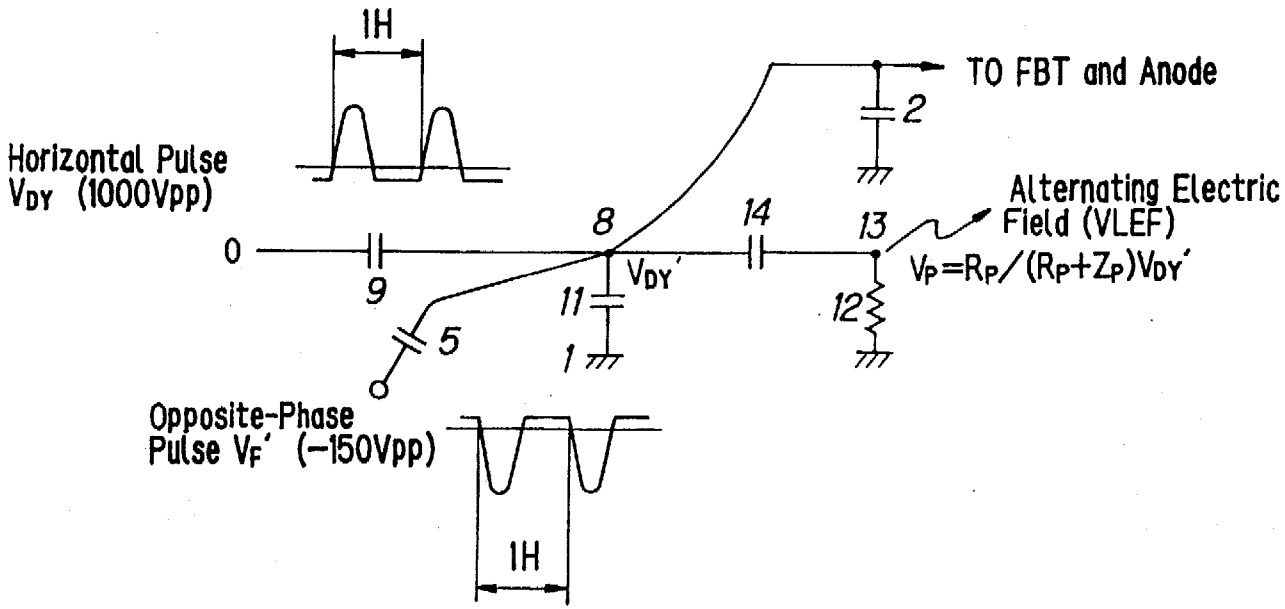
FIG. 10 PRIOR ART
FIG. 10 is a diagram illustrating an equivalent circuit for reducing the alternating electric field.
Figure 11:
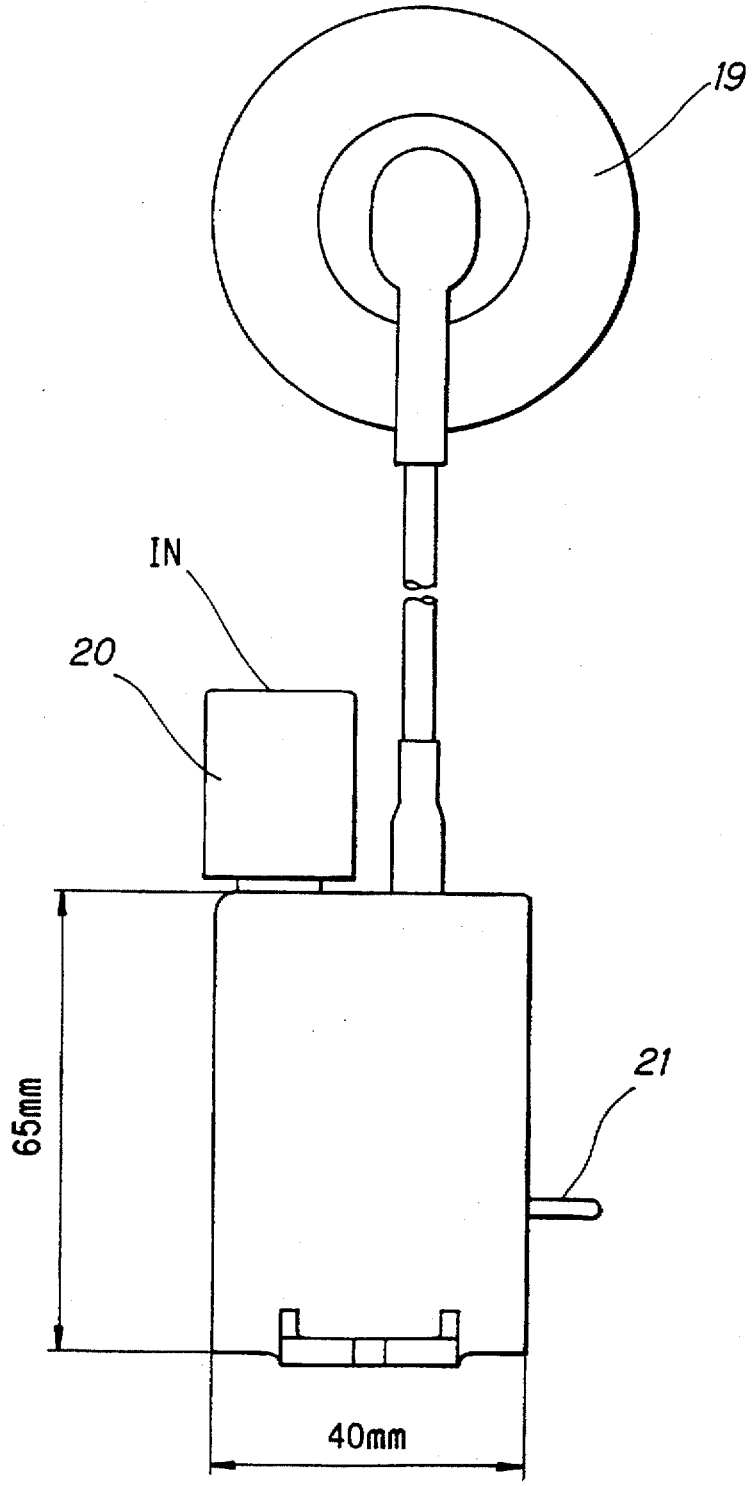
FIG. 11 PRIOR ART
FIG. 11 is a diagram illustrating the appearance of an externally-provided high-voltage capacitor of a conventional FBT.
Figure 12:
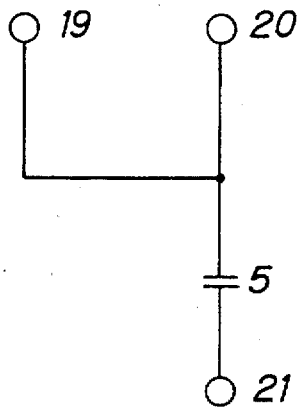
FIG. 12 PRIOR ART
FIG. 12 is a circuit diagram of the externally-provided high-voltage capacitor.

Similarly to the conventional case of FIG. 8, high-voltage rectifier diodes 3*a* to 3*d* are connected to the respective output sides (winding terminating-end sides) of multi-divided high-voltage coil pieces 6*a* to 6*d* of a secondary-side high-voltage coil 6 of an FBT 1 for supplying a high voltage to a display, but unlike the conventional case, different-core high-voltage output line 22 is wound on an opposite-phase pulse inducing different core 23 on which an opposite-phase pulse inducing coil 24 for inducing an opposite-phase pulse the peak value and phase of which are adjusted by an opposite-phase pulse control circuit 25 is wound, or passed through a hollow portion of the core 23, so as to constitute an opposite-phase pulse inducing transformer 31.

Figure 2A:
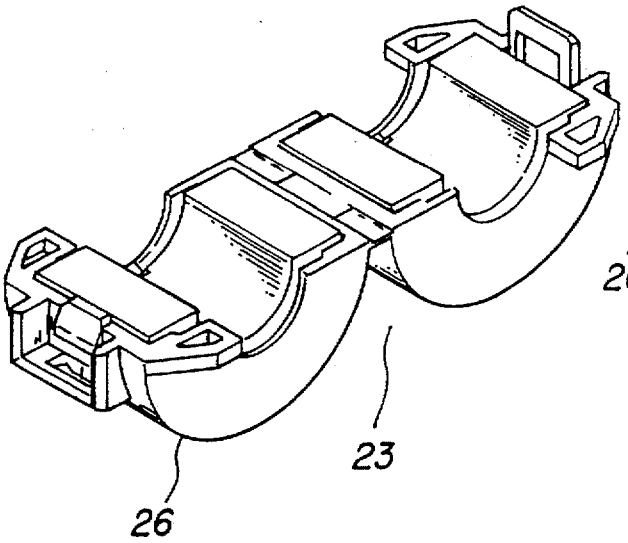
FIGS. 2A and 2B are views illustrating a halved different core used in the display monitor for inducing an opposite-phase pulse in the state where the core is opened and in the state where the core is closed, respectively.
Figure 2B:
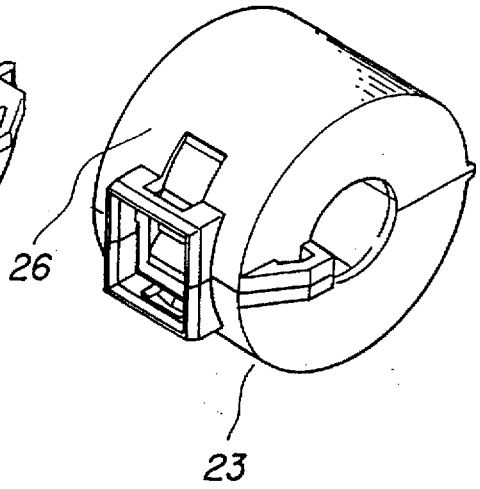

FIGS. 2A and 2B show the appearance of an example of the different core 23 for inducing an opposite-phase pulse, in which FIG. 2A shows the state where the core 23 is open, and FIG. 2B shows the state where the core 23 is closed. A so-called halved toroidal core in which a ring body is halved and the cut faces of the halves are made to abut against each other is used as the opposite-phase pulse inducing core 23, and the different-core high-voltage output line 22 is wound on or passed through the core 23. This core 23 is installed in a different-core holding casing 26, so as to constitute the opposite-phase pulse inducing transformer 31 (See also FIGS. 1 and 5).

Figure 3A:
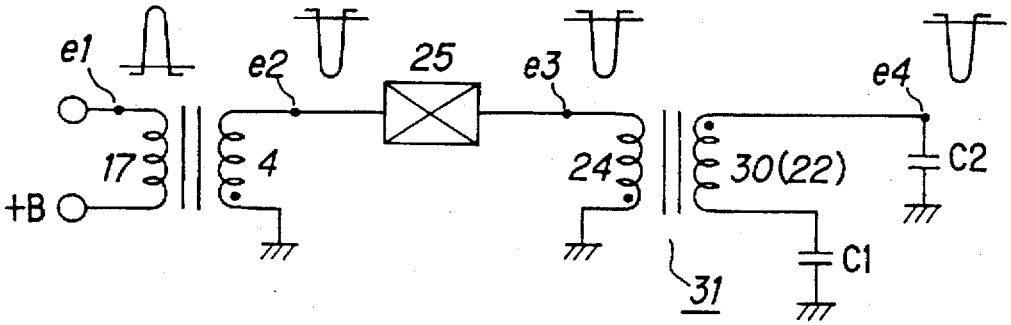
FIG. 3A is a diagram illustrating an opposite-phase pulse inducing system in the display monitor.
Figure 3B:
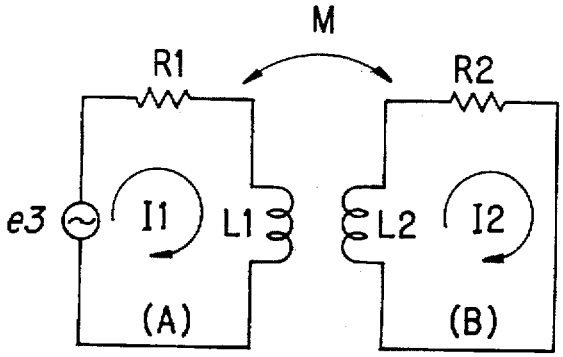
FIG. 3B is a diagram illustrating an equivalent circuit of the opposite-phase pulse inducing transformer.

FIG. 3A is a circuit diagram of an opposite-phase pulse inducing system, and FIG. 3B is an equivalent circuit diagram of an opposite-phase pulse inducing transformer. In FIG. 3A, after the peak value and phase of an opposite-phase pulse e2 generated in a tertiary-side opposite-phase pulse generating coil 4 of the FBT 1 is adjusted by the opposite-phase pulse control circuit 25, the opposite-phase pulse e2 is applied to the primary-side coil 24 of the opposite-phase pulse inducing transformer 31.

This pulse generated from the tertiary-side coil 4 of the FBT 1 is described as a negative pulse. Even if the pulse generated from the tertiary-side coil 4 is a positive pulse, however, a pulse having a phase opposite to that of a deflecting yoke driving horizontal pulse can be superimposed on the different-core high-voltage output line 22 if the direction of the winding of the opposite-phase pulse inducing coil 24 is inverted.

In FIG. 3B, let the self-inductance of the opposite-phase pulse inducing coil 24 be L1, the self-inductance of the high-voltage output line different-core winding coil 30 be L2, and the currents of circuits (A) and (B) having the respective coils $L_1$ and $L_2$ and coupled with mutual inductance M be I1 and I2 respectively, and then the following relations are established.

$$(R1+j\omega L1)I1+j\omega MI2=e3$$

$$j\omega MI1+(R2+j\omega L2)I2=0$$

where ω designates an angular frequency, that is, $\omega=2\pi f$.

The current I2 of the circuit (B) is obtained on the basis of the above expression as follows.

$$I2=[-j\omega Me3]/[(R1+j\omega L1)(R2+j\omega L2)+\omega^2M^2]$$

Therefore, an opposite-phase pulse e4 generated in the high-voltage output line different-core winding coil 30 is obtained as follows.

$$e4=[-j\omega Me3R2]/[(R1+j\omega L1)(R2+j\omega L2)+\omega^2M^2]$$

If the opposite-phase pulse e4 induced by the opposite-phase pulse inducing transformer 31 is superimposed on the different-core high-voltage output line 22, the horizontal pulse of the deflecting yoke 7 induced in the interior graphite film 8 of the cathode-ray tube 11 is canceled, so that the amplitude of the alternating electric field can be reduced.

Although the driving of the deflecting yoke 7 of the display monitor was described above by use of a positive pulse in this embodiment, the deflecting yoke 7 may be driven with a horizontal negative phase pulse in the same manner. In this case, a positive pulse is superimposed on the different-core high-voltage output line 22 through the opposite-phase pulse inducing transformer 31, so as to cancel the horizontal pulse and reduce the amplitude of the alternating electric field.

Although the peak value of the opposite-phase pulse e4 superimposed on the different-core high-voltage output line 22 can be adjusted by the number of turns of the primary-side low-voltage coil 17 of the FBT 1, the number of turns of the tertiary-side opposite-phase pulse generating coil 4, and the number of turns of the opposite-phase pulse inducing coil 24, the peak value and phase of the opposite-phase pulse e4 are finely adjusted by the opposite-phase pulse control circuit 25 in order to obtain the optimum peak value of the opposite-phase pulse e4.

Figure 4:
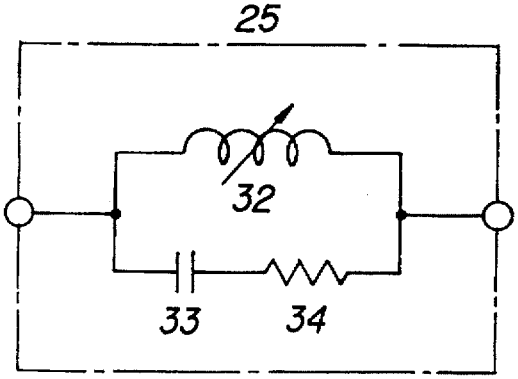
FIG. 4 is a diagram illustrating an opposite-pulse control circuit in the display monitor.

FIG. 4 shows an example of the opposite-phase pulse control circuit 25. In FIG. 4, the reference numeral 32 designates a pulse peak-value adjusting variable inductor; 33, a pulse peak-value and phase adjusting capacitor; and 34, a pulse peak-value and phase adjusting resistor. As shown in the drawing, this opposite-phase pulse control circuit 25 has such a circuit configuration that the capacitor 33 and the resistor 34 are connected in series, and the inductor 32 is connected in parallel with the series circuit of the capacitor 33 and the resistor 34. If the inductance of the variable inductor 32 is made larger, the peak value becomes smaller, and if the capacity of the capacitor 33 and the resistance of the resistor 34 are reduced, the phase is advanced, and the peak-value is increased.

In FIG. 3A, the pulse e4 across the high-voltage output line different-core winding coil 30 is capacity-shared by the capacity C1 of the built-in high-voltage capacitor 2 and capacity C2 of the cathode-ray tube. However, the pulse e4 is changed by the winding position of the coil 30 and the wiring around the coil 30.

The cathode-ray tube 11 has a limitation in capacity in view of its structure, and the built-in high-voltage capacitor 2 is provided inside the FBT 1 in order to correct the cathode-ray tube capacity. This capacity (high-voltage capacitor capacity C1+cathode-ray tube capacity C2) is for stabilization of a high voltage. If this capacity is insufficient, such a phenomenon as "tortuosity" or the like is caused on the screen of the cathode-ray tube 11.

The peak value of the opposite-phase pulse applied to the different-core high-voltage output line 22 can be adjusted by changing the capacity of the built-in high-voltage capacitor 2. That is, if the capacity of the capacitor 2 is made larger, the peak value becomes higher, and if the capacity is made smaller, the peak value becomes lower.

The present invention has both the function of capacity for applying an opposite-phase pulse to the anode of the cathode-ray tube and the function of cathode-ray tube capacity for stabilizing high voltage.

Figure 5:
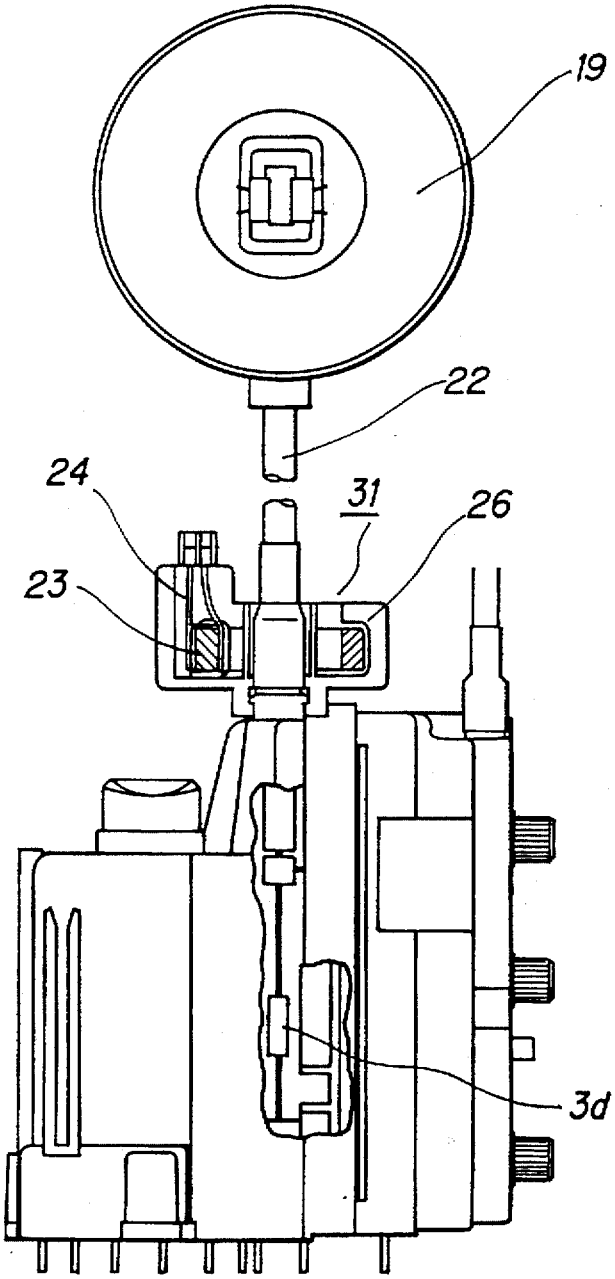
FIG. 5 is a partially-broken front view of an FBT used in the display monitor.

FIG. 5 shows the partially broken appearance of the FBT 1 for supplying a high voltage to the cathode-ray tube. As shown in FIG. 5, the opposite-phase pulse inducing coil 24 is wound on the opposite-phase pulse inducing different-core 23 held by the different-core holding casing 26 so as to constitute the opposite-phase pulse inducing transformer 31.

Figure 6:
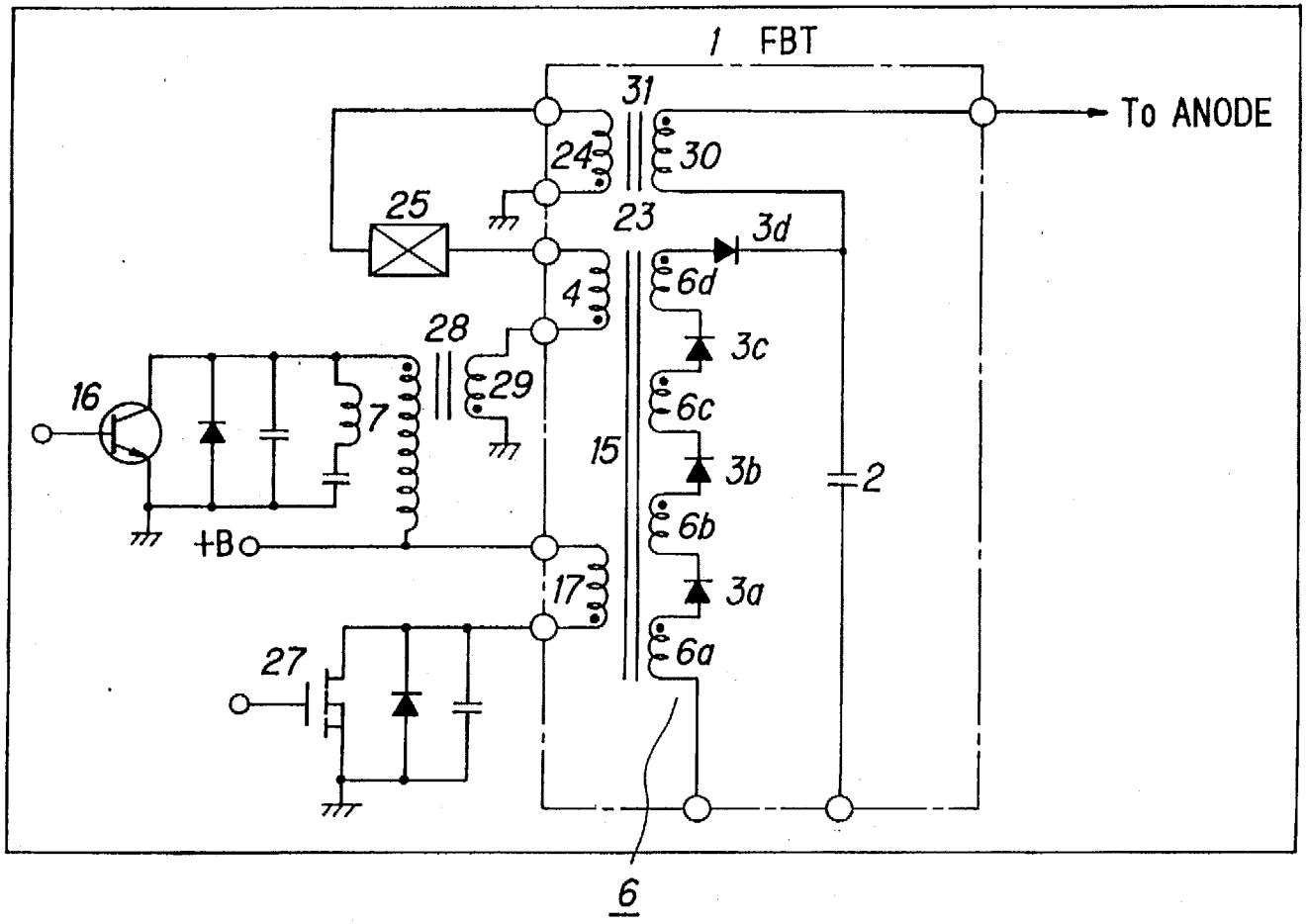
FIG. 6 is a circuit diagram of a display monitor according to another embodiment of the present invention.
Figure 7A:
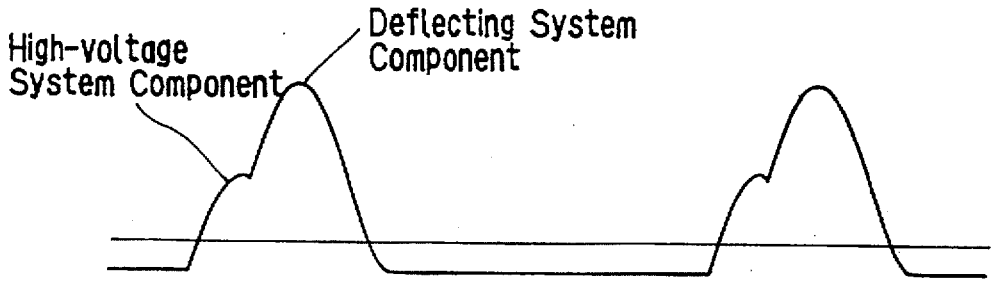
FIG. 7A is a diagram illustrating a pulse waveform induced in an interior graphite film of a cathode-ray tube of a high-voltage deflecting system separation type.
Figure 7B:
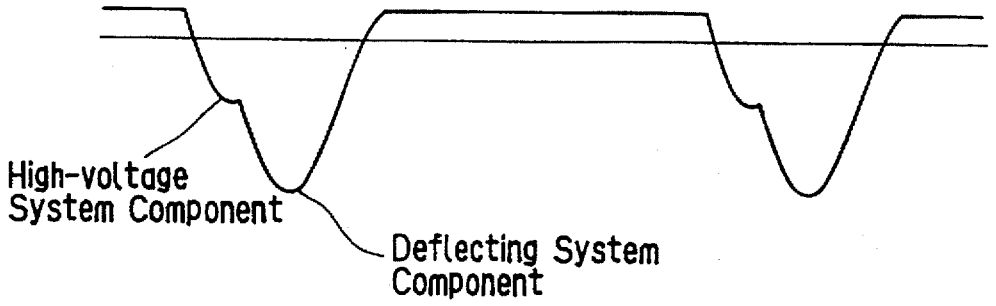
FIG. 7B is a diagram illustrating a pulse waveform induced by an opposite-phase pulse inducing transformer.

FIG. 6 is a circuit diagram of an FBT 1 according to another embodiment, FIG. 7A is a waveform diagram of a pulse induced in an interior graphite film of a high-voltage deflecting system separation type, and FIG. 7B is a waveform diagram of a pulse induced in an opposite-phase pulse inducing transformer according to the embodiment of FIG. 6.

When a display monitor has a large-sized cathode-ray tube, there is a case where a deflection system and a high-voltage system are driven separately by a horizontal output transistor 16 and by a field-effect transistor (FET) 27 in order to improve the picture quality.

In the case where the high-voltage system and the deflection system are driven separately, since the switching timing of the FET 27 is earlier than that of the transistor 16, there arises a phase difference between a high-voltage system component and a deflection system component in a pulse induced in the interior graphite film 8 of the FBT 1 as shown in FIG. 7A. The high-voltage system component is generated because the inner impedance of the built-in high-voltage capacitor 2 is large or because the quantity of high voltage variation of the FBT 1 is large, and the high-voltage system component is combined with a deflection system pulse induced in the interior graphite film 8 of the cathode-ray tube 11 through the capacity 9 of the deflecting yoke so as to produce such a pulse waveform as shown in FIG. 7A.

Therefore, as shown in FIG. 6, a deflection-system dummy transformer 28 having a deflection-system opposite-phase pulse generating coil 29 is provided, and an opposite-phase pulse the peak value and phase of which are adjusted by the opposite-phase pulse control circuit 25 through the tertiary-side opposite-phase pulse generating coil 4 of the FBT 1 is superimposed on the different-core high-voltage output line 22 through the transformer 31, so that the combined pulse voltage ([FIG. 7A]) is canceled with the opposite-phase pulse voltage ([FIG. 7B]) in the interior graphite film 8 of the cathode-ray tube 11. It is therefore possible to reduce the amplitude of an alternating electric field.

The opposite-phase pulse inducing transformer 31 integrated with the FBT 1 may be separated from the FBT 1 so as to be externally provided in a desired position.

As has been described, according to the present invention, an opposite-phase pulse is superimposed on a different-core high-voltage output line through an opposite-phase pulse inducing transformer, so that it is possible to reduce an alternating electric field. Accordingly, it is not necessary to provide an externally-provided high-voltage capacitor which is insulated by an exterior housing and injection resin and which is therefore expensive. It is therefore possible to provide a display monitor which is low in price, easy in high-voltage insulation and good in handling.

What is claimed is:

1. A display monitor comprising:

a flyback transformer for supplying a high voltage to a display, said flyback transformer including a core, a primary-side low-voltage coil wound on said core, a secondary-side high-voltage coil wound on said core and divided into high-voltage coil pieces, high-voltage rectifier diodes connected in series with respective output sides of said high-voltage coil pieces of said secondary-side high-voltage coil so as to form a series circuit, and a high-voltage capacitor connected to a cathode of one of said high-voltage rectifier diodes in a final stage of said series circuit;

an opposite-phase pulse inducing transformer constituted by a core different from said core of said flyback transformer, an opposite-phase pulse inducing coil wound on said different core for inducing a pulse which is opposite in phase to a deflecting yoke driving horizontal pulse, and a different-core high-voltage output line connected to an output side of said secondary-side high-voltage coil and arranged on said different core, said opposite phase pulse inducing transformer being arranged so that said pulse opposite in phase to said deflecting yoke driving horizontal pulse is superimposed on said different-core high-voltage output line and an output terminal of said different-core high-voltage output line is connected to said display; and an opposite-phase pulse control circuit for adjusting the peak value and phase of said pulse opposite in phase to said deflecting yoke driving horizontal pulse, said opposite-phase pulse control circuit being connected to said opposite-phase pulse inducing transformer.

2. A display monitor according to claim 1, wherein said opposite-phase pulse control circuit includes an inductor connected in parallel with a series circuit which is constituted by a capacitor and a resistor.

3. A display monitor according to claim 1, wherein said pulse opposite in phase to said deflecting yoke driving horizontal pulse is generated by said flyback transformer, and supplied to a cathode-ray tube through said opposite-phase pulse inducing transformer.

4. A display monitor according to claim 1, wherein the core of said opposite-phase pulse inducing transformer is a halved toroidal core in which a ring-shaped core is halved and cut surfaces of the halves are made abut against each other.

* * * * *